US006081248A

United States Patent [19]

Hasegawa et al.

[11] Patent Number: 6,081,248

[45] Date of Patent: Jun. 27, 2000

[54] COLOR DISPLAY DEVICE

[75] Inventors: Masao Hasegawa; Yukihiro Sekiguchi; Yoshinobu Inoue; Yoshimitsu Uzawa; Osamu Kawai, all of Mobara, Japan

[73] Assignee: Futaba Denshi Koyo K.K., Mobara, Japan

[21] Appl. No.: 08/932,184

[22] Filed: Sep. 17, 1997

[30] Foreign Application Priority Data

Sep. 19, 1996 [JP] Japan ..... 8-247890

[51] Int. Cl.[7] ..... G09G 3/22

[52] U.S. Cl. ..... 345/75; 345/76

[58] Field of Search ..... 345/75, 74, 47, 345/76

[56] References Cited

U.S. PATENT DOCUMENTS 4,237,459 12/1980 Cordova ..... 345/75
4,484,347 11/1984 Kashioka ..... 382/296
4,540,983 9/1985 Morimoto et al. ..... 345/75
4,623,882 11/1986 Nixon ..... 345/75
5,497,171 3/1996 Teres et al. ..... 345/43

*Primary Examiner*—Richard A. Hjerpe
*Assistant Examiner*—Ronald Laneau
*Attorney, Agent, or Firm*—Oblon, Spivak, McClelland, Maier & Neustadt, P. C.

[57] ABSTRACT

A color display device capable of preventing discontinuity of a line in a single-color display by improving a pattern of dividing of a luminous unit. The color display device includes a plurality of picture cells each constituted by a plurality of luminous units emitting lights different in luminous color from each other. Each two luminous units which have a triangular shape formed by dividing a quadrilateral into two along a diagonal line thereof and constitute each of the picture cells each are permitted to emit light of one of luminous colors different from each other. Such construction, even when only one of the two luminous units constituting each of the picture cells is excited for single-color display, permits luminous units of the same color in the picture cells P adjacent to each other in the longitudinal and lateral directions to be observed in a manner to be continuously connected to each other at the apexes opposite to each other.

8 Claims, 5 Drawing Sheets

COLOR DISPLAY DEVICE

BACKGROUND OF THE INVENTION

This invention relates to a color display device including a plurality of picture cells each constituted by a plurality of luminous units emitting lights different in luminous color from each other, and more particularly to an improvement in a pattern by which a plurality of picture cells each are divided into luminous units.

Color graphic display devices which have been conventionally known in the art include display devices constructed on the basis of various display or luminous principles such as, for example, a fluorescent display device, a plasma display device, a liquid crystal display device, an EL display device and the like. Such color display devices each are generally constructed in such a manner that a display plane is constituted by a number of picture cells, each of which is then divided into a plurality of luminous cells emitting lights different in luminous color from each other.

Now, a fluorescent display device will be described by way of example. The fluorescent display device includes anodes constituting a display plane. The anodes each are constructed of a number of picture cells, each of which is divided into luminous units of red (R), green (G) and blue (B) luminous colors. Thus, driving of each of the luminous units of the picture cells for luminescence in any desired manner permits a desired color image to be displayed on the display plane by a combination of the colors.

FIG. 7 shows an example of a pattern of dividing of picture cells in a conventional fluorescent display device which is an example of a color display device. A plurality of picture cells constituting a display plane each are constructed of two rectangular luminous units arranged adjacently to each other in a longitudinal direction. More particularly, the picture cells each are separated into two luminous units by a dividing line extending in a lateral direction. Referring now to, for example, two luminous units 1-1A and 1-1B in FIG. 7, the upper luminous unit 1-1A emits light of a green luminous color and the lower luminous unit 1-1B emits orange-colored light. Thus, the luminous cells each constituted by two green and orange-colored luminous units are arranged in a pattern of m rows and 2n columns, resulting in constituting a long-sideways rectangular display plane or a display plane which has a length increased in a lateral direction as compared with a longitudinal direction. In FIG. 7, reference characters 1G to nG designate control electrodes arranged in correspondence to the rows of the picture cells.

In the fluorescent display device thus constructed, for example, subsequent scanning of the control electrodes and feeding of a display signal to the luminous units of each of the picture cells at a suitable timing permit any desired character, image or the like to be not only displayed in three colors on the long-sideways rectangular display plane but scrolled in any desired direction.

Unfortunately, dividing of each of the picture cells into the luminous units in such a pattern as shown in FIG. 7 often causes a failure in display of a line continuous in a particular direction. Now, a situation that two Japanese kanji characters "双葉", which correspond to "Futaba" in Roman characters, are respectively displayed in two single-colors as shown in FIG. 8 in such a pattern of arrangement of the luminous units as shown in FIG. 7 will be considered by way of example. In FIG. 8, the character "双" is displayed in a green color by the upper green luminous unit of the two luminous units constituting each picture cell, whereas the character "葉" is displayed in an orange-color by the lower orange-colored luminous unit. Such display of each character in each single-color by each of the two picture cells vertically or longitudinally divided from each other fails to permit each of lines in any direction other than a lateral direction to be continuous. Thus, lines extending in a longitudinal or oblique direction each are rendered discontinuous due to formation of a gap between the luminous units. This causes visual observation of the character displayed in the single color to be hard, leading to a deterioration in visibility of the display.

SUMMARY OF THE INVENTION

The present invention has been made in view of the foregoing disadvantage of the prior art.

It is an object of the present invention to provide a color display device including a plurality of picture cells each constituted by a plurality of luminous units emitting lights different in luminous color from each other which is capable of effectively preventing discontinuity of a line displayed in a single color as well as in a multicolor through an improvement in a pattern of dividing of the picture cell into the luminous units.

In accordance with the present invention, a color display device is provided. The color display device includes a plurality of picture cells each constituted by a plurality of luminous units emitting lights different in luminous color from each other, respectively. The luminous units each are formed into a triangular shape. Each two luminous units of the same luminous color in each two picture cells which are adjacent to each other in any direction are arranged in such a manner that any one apex of one of the two luminous units is opposite to any one apex of the other luminous unit.

Also, in accordance with the present invention, a color display device is provided. The color display device includes a plurality of picture cells each constituted by a plurality of luminous units each emitting light of any one of two luminous colors. The picture cells each are formed into a quadrilateral. The luminous units each are formed into a triangular shape obtained by dividing the quadrilateral into two along a diagonal line of the quadrilateral.

In a preferred embodiment of the present invention, the picture cells are arrayed in longitudinal and lateral directions and formed into a quadrilateral. The luminous units of each of the picture cells each are formed into a right-angled triangular shape obtained by dividing the quadrilateral into two along a diagonal line of said quadrilateral which extends in a direction predetermined commonly to the picture cells.

In another preferred embodiment of the present invention, the picture cells are arrayed in longitudinal and lateral directions and formed into a quadrilateral. The luminous units of each of the picture cells each are formed into a right-angled triangular shape obtained by dividing the quadrilateral into four along two diagonal lines of the quadrilateral.

In a preferred embodiment, the quadrilateral is a rectangle. Alternatively, the quadrilateral may be a rhombus.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
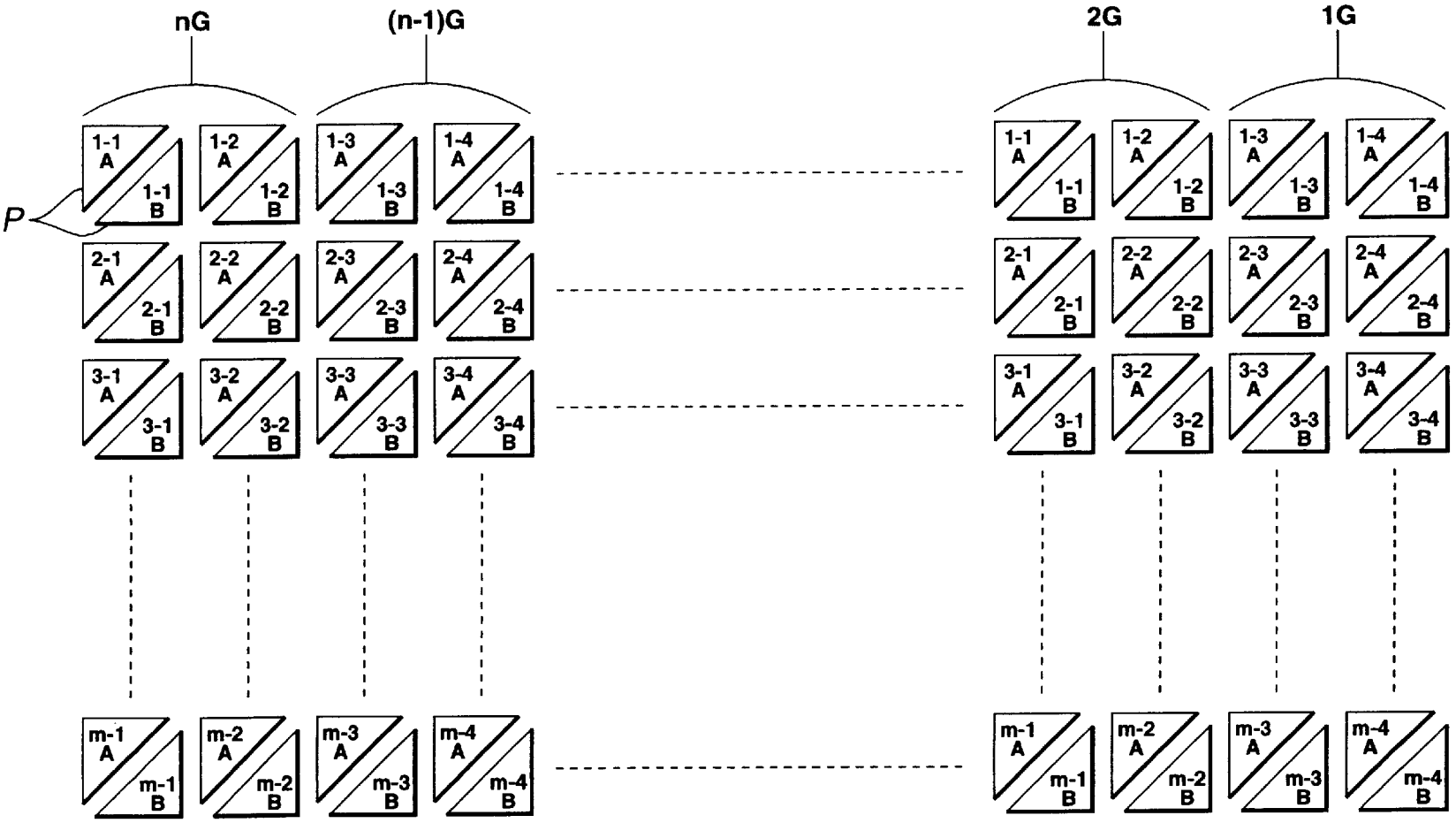
FIG. 1 is a graphical representation showing a pattern of arrangement of picture cells of a display region formed in a first embodiment of a color display device according to the present invention.

Now, a color display device according to the present invention will be described hereinafter with reference to FIGS. 1 to 6, wherein like reference characters designate like or corresponding parts throughout.

Figure 2:
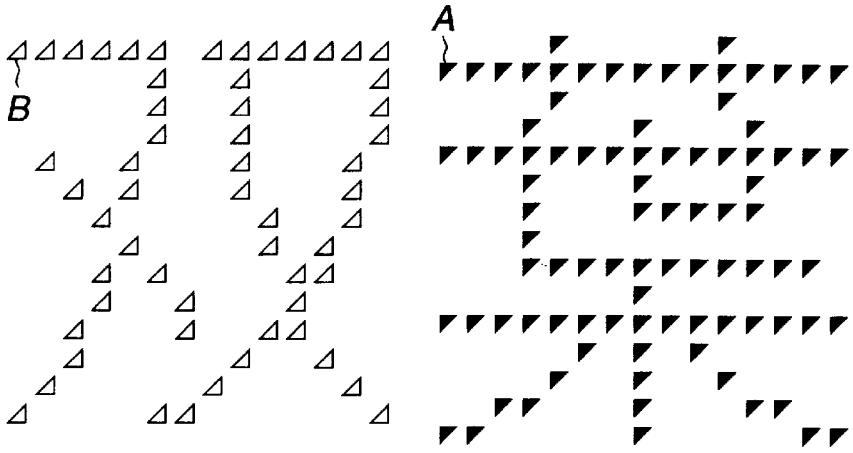
FIG. 2 is a graphical representation showing characters each displayed in a unicolor or single color in the color display device of FIG. 1.

Referring first to FIGS. 1 and 2, a first embodiment of a color display device according to the present invention is illustrated. A color display device of the illustrated embodiment is constructed in the form of a fluorescent display device. The fluorescent display device includes an envelope formed into a shape like a closed box and evacuated to a high vacuum. The envelope is generally formed of insulating glass plates. More particularly, it is formed by arranging a frame-like side plate made of glass between an outer periphery of an anode substrate and that of a transparent front cover which are made of glass and arranged opposite to each other and then sealedly joining the anode substrate, front cover and side plate to each other by means of a sealing material. The anode substrate is formed on an inner surface thereof with picture cells P each consisting of luminous units arranged or arrayed in a predetermined pattern. The luminous units each are constructed of a combination of an anode conductor made of a film of aluminum or the like and a phosphor of a predetermined luminous color deposited on the anode conductor.

A plurality of picture cells P constituting a display plane of the fluorescent display device of the illustrated embodiment, as shown in FIG. 1, each include two luminous units A and B arranged at an upper-left position of the picture cell and a lower-right position thereof, respectively. More particularly, the picture cells P each are formed into a substantially square shape, which is divided into two luminous units A and B of a right-angled isosceles triangle by a diagonal line of the square extending from a lower-left corner of the square to an upper-right corner thereof. The picture cells P each are so constructed that the left-hand luminous unit A thereof emits light of a green luminous color and the right-hand luminous unit B emits orange-colored light. The picture cells P each consisting of the two green and orange-colored luminous units A and B of a triangular shape are arrayed in a pattern of m rows and 2n columns, resulting in constituting a display plane of a long-sideways rectangular shape. Such configuration and arrangement of the picture cells P and luminous units A and B permit each two luminous units of the same luminous color in each two picture cells P which are adjacent to each other in any direction in the display plane to be arranged in such a manner that any one apex of one of the two luminous units is opposite to any one apex of the other luminous unit.

The fluorescent display device of the illustrated embodiment also includes control electrodes arranged above the anodes in the envelope. The control electrodes are designated by reference characters 1G to nG in FIG. 1. Also, the fluorescent display device includes filamentary cathodes stretchedly arranged above the control electrodes in the envelope.

In the fluorescent display device thus constructed, when the control electrodes are scanned and the luminous units A and B of the picture cells P are fed with a display signal in synchronism with such scanning of the control electrodes, electrons emitted from the filamentary cathodes are impinged on the luminous units A and B of the picture cells P while being subject to acceleration and control by the control electrodes. This results in a desired display being obtained in a green, orange or red color on the display region. The display region of the fluorescent display device, as described above, is formed into a long-sideways rectangular shape, so that subsequent scrolling of the display in the long-sideways direction may provide a display exhibiting an increased propaganda effect.

Such dividing of each of the picture cells P into the luminous units A and B of a triangular shape as shown in FIG. 1 permits both a longitudinal line and a lateral line to be displayed in a continuous manner. Now, it is supposed that such Japanese kanji characters "双葉" as described are respectively displayed in two single colors as shown in FIG. 2. The character "双" is displayed in an orange color by the lower-right orange-colored luminous unit B of the two luminous units A and B constituting each picture cell P, whereas the character "葉" is displayed in a green color by the upper-left green luminous unit A.

In the illustrated embodiment, the picture cells P which are regularly arranged in longitudinal and lateral directions and formed into a square each are constituted by the two luminous units A and B of a right-angled triangular shape formed by dividing a square into two along a diagonal line of the square, so that each two luminous units of the same luminous color in each two picture cells P which are adjacent to each other in both longitudinal and lateral directions are arranged in such a manner that any one apex of one of the two luminous units is rendered opposite to any one apex of the other luminous unit. Thus, even when only one of the two luminous units A and B constituting each of the picture cells P is excited for single-color display, luminous units of the same color in the picture cells P adjacent to each other in the longitudinal or lateral direction are observed in a manner to be continuously connected to each other at the apexes opposite to each other. This permits even a character displayed in a single color to be released from such indistinctness as caused by the above-described conventional rectangular luminous units, so that the character may be highly visible and exhibit good outward appearance.

Figure 3:
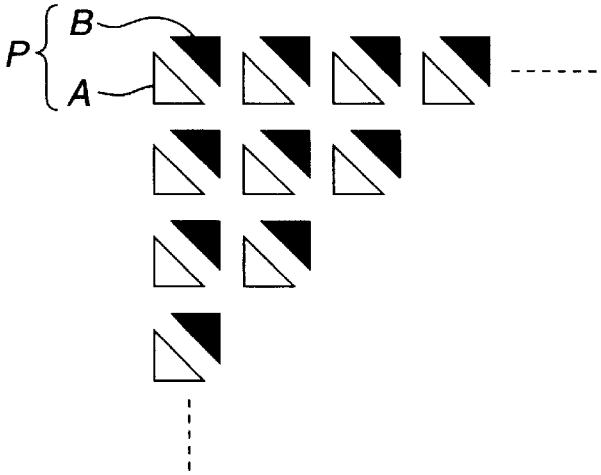
FIG. 3 is a graphical representation showing a part of a pattern of arrangement of picture cells in a display region formed in a second embodiment of a color display device according to the present invention.

Referring now to FIG. 3, a second embodiment of a color display device according to the present invention is illustrated. Picture cells P each are substantially formed into a square and divided into two luminous units A and B of a right-angled isosceles triangle by a diagonal line of the square extending from a lower-right corner of the square to an upper-left corner thereof. The remaining part of the second embodiment may be constructed in substantially the same manner as the first embodiment described above. Thus, it will be noted that the second embodiment exhibits substantially the same advantage as the first one.

Figure 4:
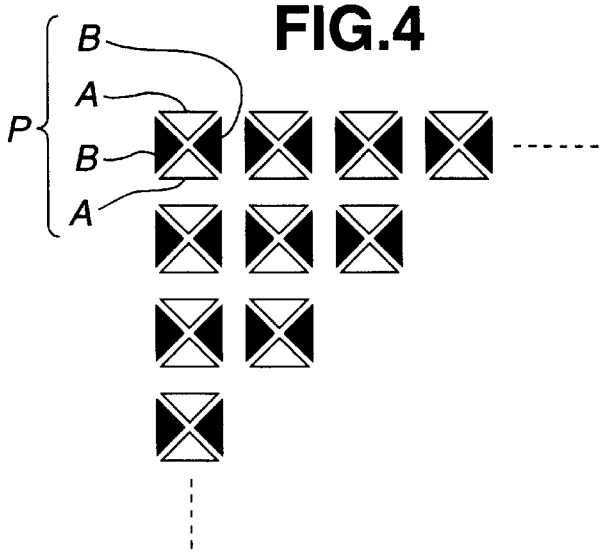
FIG. 4 is a graphical representation showing a part of a pattern of arrangement of picture cells in a display region formed in a third embodiment of a color display device according to the present invention.

Referring now to FIG. 4, a third embodiment of a color display device according to the present invention is illustrated. Picture cells P each are substantially formed into a square and divided into four luminous units A and B of an right-angled isosceles triangle by two diagonal lines of the square. Thus, the picture cells each include two luminous units A of a green luminous color and two orange-colored luminous units B. The remaining part of the second embodiment may be constructed in substantially the same manner as the first embodiment described above. Thus, it will be noted that the third embodiment exhibits substantially the same advantage as the first one.

Figure 5:
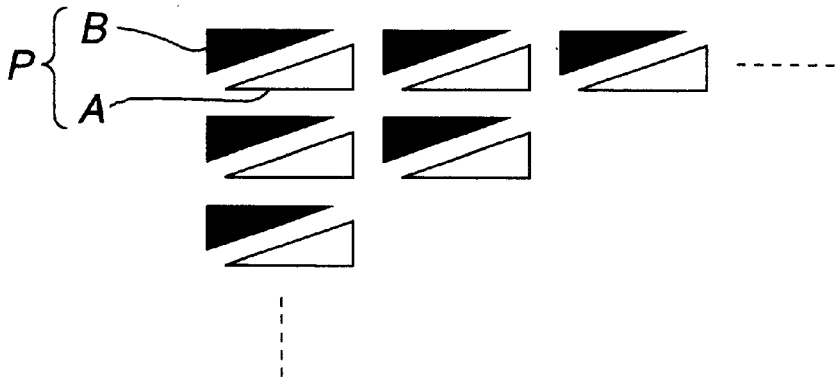
FIG. 5 is a graphical representation showing a part of a pattern of arrangement of picture cells in a display region formed in a fourth embodiment of a color display device according to the present invention.

Referring now to FIG. 5, a fourth embodiment of a color display device according to the present invention is illustrated. Picture cells P each are substantially formed into a rectangle and divided into two luminous units A and B of a right-angled isosceles triangle by a diagonal line of the rectangle extending from a lower-left corner of the rectangle to an upper-right corner thereof. The remaining part of the fourth embodiment may be constructed in substantially the same manner as the first embodiment described above. Thus, it will be noted that the second embodiment exhibits substantially the same advantage as the first one.

Figure 6:
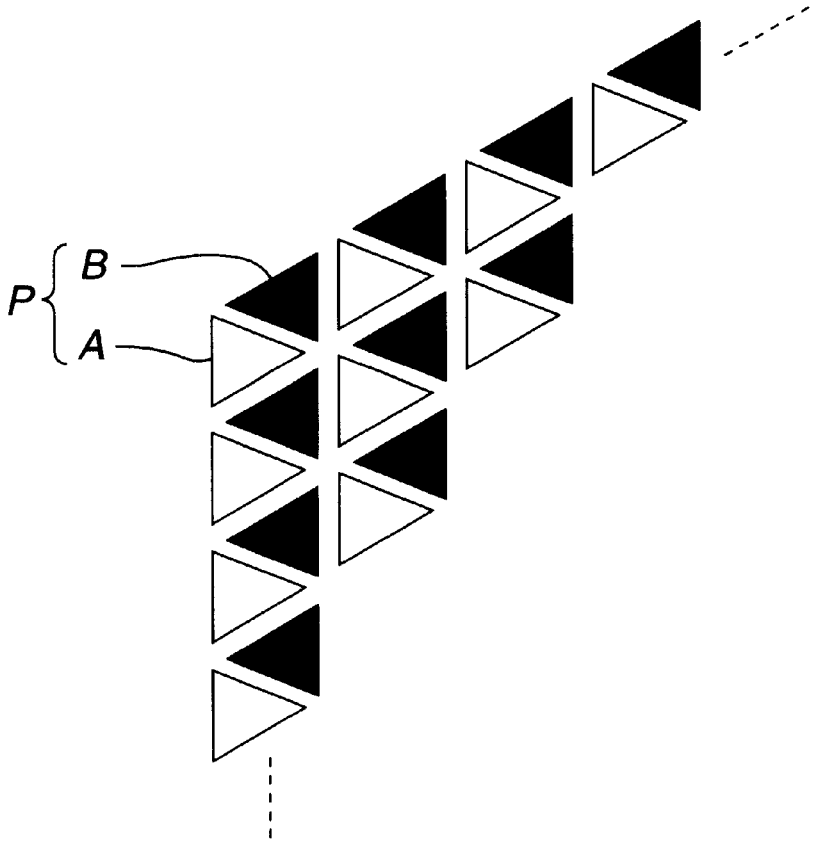
FIG. 6 is a graphical representation showing a part of a pattern of arrangement of picture cells in a display region formed in a fifth embodiment of a color display device according to the present invention.
Figure 7:
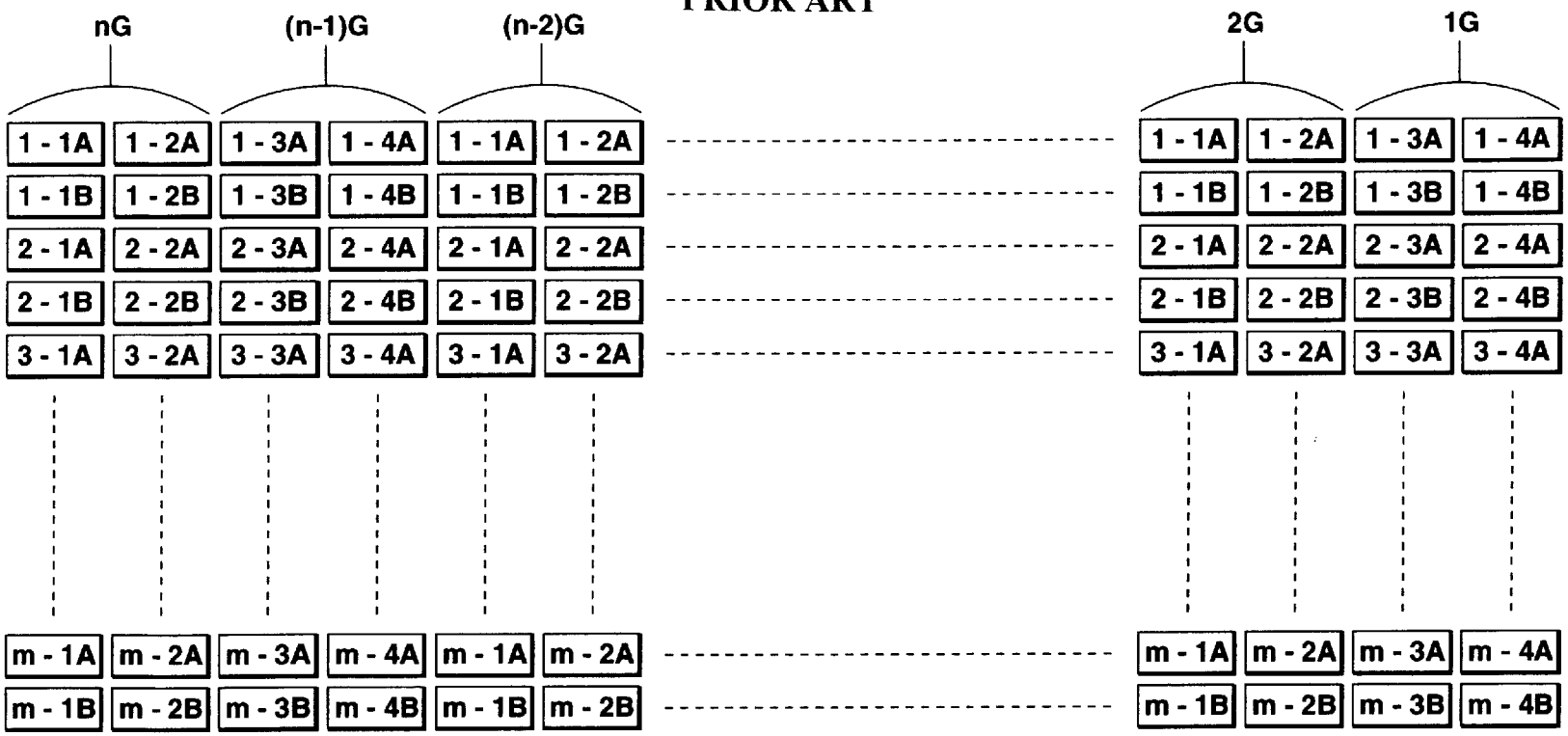
FIG.7 PRIOR ART
FIG. 7 is a graphical representation showing an example of a pattern of arrangement of picture cells in a display region formed in a conventional color display device.
Figure 8:
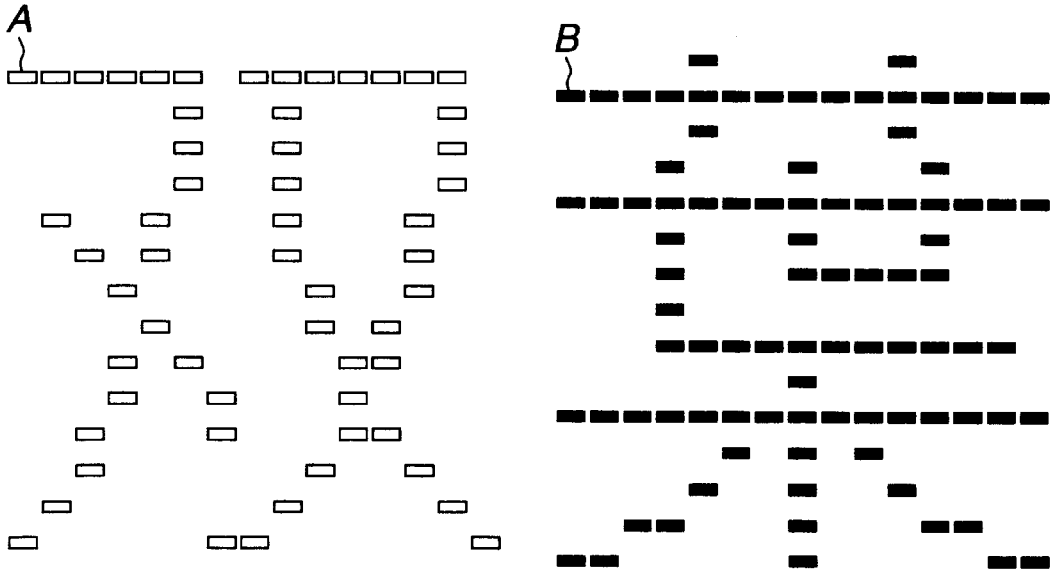
FIG.8 PRIOR ART
FIG. 8 is a graphical representation showing characters each displayed in a unicolor or single color in the color display device of FIG. 7.

Referring now to FIG. 6, a fifth embodiment of a color display device according to the present invention is illustrated. Picture cells P each are substantially formed into a rhombus and divided into two luminous units A and B of a triangle by a diagonal line of the rhombus. The remaining part of the fifth embodiment may be constructed in substantially the same manner as the first embodiment described above. Thus, it will be noted that the second embodiment exhibits substantially the same advantage as the first one.

The color display device of each of the embodiments described above is directed to the fluorescent display device wherein luminescence of the phosphor of each of the anodes arranged on the anode substrate is observed through the front cover arranged opposite to the anode substrate. In addition, the present invention may be likewise effectively applied to a fluorescent display device which is constructed in such a manner that luminescence of each of phosphors is observed through an anode substrate and an anode conductor. Also, the filamentary cathode is incorporated in the form of an electron source in the fluorescent display device of each of the embodiments. Alternatively, an area electron source such as a field emission cathode or the like may be used for this purpose.

Also, the embodiments described above each are directed to a fluorescent display device. In addition, the present invention is likewise applicable to any other color display device such as a plasma display device, a liquid crystal display device, an EL display device or the like irrespective of a display or luminous principle thereof, so long as a luminous region thereof may be constituted by picture cells each constructed of luminous units.

As can be seen from the foregoing, the color display device of the present invention is so constructed that each two luminous units which have a triangular shape formed by dividing a quadrilateral into two along a diagonal line thereof and constitute each of the picture cells each are permitted to emit light of one of luminous colors different from each other. Such construction, even when only one of the two luminous units A and B constituting each of the picture cells P is excited for single-color display, permits the luminous units of the same color in the picture cells P adjacent to each other in the longitudinal or lateral direction to be observed in a manner to be continuously connected to each other at the apexes thereof opposite to each other.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A color display device comprising:

a plurality of quadrilateral picture cells spaced apart and arranged in a matrix, each picture cell constituted by a plurality of luminous units emitting lights different in luminous color from each other, respectively;

said luminous units each being formed into a triangular shape formed along a diagonal of said quadrilateral picture cell, so as to form two luminous lines emitting lights different in luminous color from each other;

wherein each two luminous units of the same luminous color in two respective picture cells which are adjacent to each other in any direction are arranged in such a manner that each apex of a first of the two luminous units is opposite to an apex of a second of the two luminous units.

2. A color display device according to claim 1, wherein the plurality of quadrilateral picture cells display Kanji characters.

3. A color display device comprising:

a plurality of picture cells spaced apart and arranged in a matrix, each picture cell constituted by a plurality of luminous units each emitting light of any one of two luminous colors;

said picture cells being formed into a quadrilateral;

said luminous units each being formed into a triangular shape obtained by dividing said quadrilateral into two along a diagonal line of said quadrilateral so as to form two lines emitting lights different in luminous color from each other;

wherein each two luminous units of the same luminous color in two respective picture cells which are adjacent to each other in any direction are arranged in such a manner that each apex of a first of the two luminous units is opposite to an apex of a second of the two luminous units.

4. A color display device as defined in claim 3, wherein said picture cells are arrayed in longitudinal and lateral directions and formed into a quadrilateral;

said luminous units of each of said picture cells each being formed into a right-angled triangular shape obtained by dividing said quadrilateral into two along a diagonal line of said quadrilateral which extends in a direction predetermined commonly to said picture cells.

5. A color display device as defined in claim 3, wherein said picture cells are arrayed in longitudinal and lateral directions and formed into a quadrilateral;

said luminous units of each of said picture cells each being formed into a right-angled triangular shape obtained by dividing said quadrilateral into four along two diagonal lines of said quadrilateral.

6. A color display device as defined in claim 3, wherein said quadrilateral is a rectangle.

7. A color display device as defined in claim 3, wherein said quadrilateral is a rhombus.

8. A color display device according to claim 3, wherein the plurality of picture cells display Kanji characters.

* * * * *

UNITED STATES PATENT AND TRADEMARK OFFICE

CERTIFICATE OF CORRECTION

PATENT NO. : 6,081,248

DATED : June 27, 2000

INVENTOR(S): Masao HASEGAWA et al.

It is certified that an error appears in the above-identified patent and that said Letters Patent is hereby corrected as shown below:

On the title page, item [73], the Assignee's name is misspelled. It should be:

--[73] Assignee: Futaba Denshi Kogyo K.K., Mobara, Japan--

Signed and Sealed this

Tenth Day of April, 2001

*Attest:*

Nicholas P. Godici

NICHOLAS P. GODICI

*Attesting Officer*

*Acting Director of the United States Patent and Trademark Office*